US008511135B2

(12) United States Patent
Kuwayama et al.

(10) Patent No.: US 8,511,135 B2
(45) Date of Patent: Aug. 20, 2013

(54) BENDING APPARATUS

(75) Inventors: Shinjiro Kuwayama, Osaka (JP); Atsushi Tomizawa, Minou (JP); Saburo Inoue, Tama (JP)

(73) Assignees: Nippon Steel & Sumitomo Metal Corporation, Tokyo (JP); Sumitomo Pipe & Tube Co., Ltd., Ibaraki (JP)

( * ) Notice: Subject to any disclaimer, the term of this patent is extended or adjusted under 35 U.S.C. 154(b) by 0 days.

(21) Appl. No.: 13/300,720

(22) Filed: Nov. 21, 2011

(65) Prior Publication Data

US 2012/0079866 A1 Apr. 5, 2012

Related U.S. Application Data

(63) Continuation of application No. PCT/JP2010/058301, filed on May 17, 2010.

(30) Foreign Application Priority Data

May 19, 2009 (JP) ..... 2009-120845

(51) Int. Cl.
*B22D 43/10* (2006.01)

(52) U.S. Cl.
USPC ..... 72/422; 72/307; 72/342.6; 72/217; 72/128

(58) Field of Classification Search
USPC ..... 72/295, 298, 299, 149, 150, 152, 72/306, 307, 369, 419, 342.6, 422
See application file for complete search history.

(56) References Cited

U.S. PATENT DOCUMENTS

| | | | | |
|---|---|---|---|---|
| 2,990,257 | A * | 6/1961 | Heneage et al. | 422/250.1 |
| 4,062,216 | A * | 12/1977 | Hanamoto et al. | 72/128 |
| 5,335,529 | A * | 8/1994 | Crowdus et al. | 72/404 |
| 6,434,993 | B1 * | 8/2002 | Broggi et al. | 72/157 |
| 7,134,310 | B2 * | 11/2006 | Hu | 72/307 |
| 7,143,621 | B2 * | 12/2006 | Bruyas et al. | 72/157 |
| 2011/0211938 | A1 * | 9/2011 | Eakins et al. | 414/738 |

FOREIGN PATENT DOCUMENTS

| | | |
|---|---|---|
| WO | 2006/049165 | 5/2006 |
| WO | 2006/093006 | 9/2006 |
| WO | 2008/123505 | 10/2008 |

* cited by examiner

*Primary Examiner* — Dana Ross
*Assistant Examiner* — Homer Boyer
(74) *Attorney, Agent, or Firm* — Clark & Brody

(57) ABSTRACT

A bending apparatus for manufacturing a bent member from a steel pipe with high dimensional accuracy and high productivity can be installed in a small space with good maintainability. The apparatus has a feed mechanism for feeding a steel pipe in its lengthwise direction, a first support mechanism for supporting the steel pipe while feeding it, a heating mechanism for heating a part or all of the steel pipe being fed, a cooling mechanism for cooling the portion of the heated steel pipe being fed, a second support mechanism for imparting a bending moment to the heated portion of the steel pipe to bend the steel pipe into a desired shape by moving two-dimensionally or three-dimensionally while supporting the fed steel pipe in at least one location, and a deformation preventing mechanism for preventing deformation of the steel pipe. The feed mechanism is a vertically articulated robot having seven axes.

5 Claims, 2 Drawing Sheets

BENDING APPARATUS

TECHNICAL FIELD

This invention relates to a bending apparatus having an industrial robot as a component. Specifically, the present invention relates to a bending apparatus for manufacturing a bent member by applying two-dimensional or three-dimensional bending to a long metal blank having a closed cross section.

BACKGROUND ART

Strength members, reinforcing members, or structural members made of metal and having a bent shape are used in automobiles and various types of machines and the like. These bent members need to have a high strength, a light weight, and a small size. This type of bent member has been manufactured by welding of press formed members, punching of a plate, forging, and the like. However, it is difficult to further reduce the weight and size of bent members manufactured by these manufacturing methods.

In recent years, the manufacture of this type of bent member by the so-called tube hydroforming technique has been actively studied (see Non-Patent Document 1, for example). As described on page 28 of Non-Patent Document 1, there are various challenges in the tube hydroforming technique, such as the development of materials for use in the method and increasing the degree of freedom of shapes which can be formed, and therefore further technological developments are necessary in the future.

In Patent Document 1, the present applicant disclosed a bending apparatus. FIG. 3 is an explanatory view schematically showing that bending apparatus 0.

As shown in FIG. 3, the bending apparatus 0 manufactures a bent member 8 which intermittently or continuously has a bent portion which is bent two-dimensionally or three-dimensionally and a quench hardened portion in its lengthwise direction and/or in the circumferential direction in a surface which intersects the lengthwise direction, with a high operating efficiency while maintaining an adequate bending accuracy. To this end, the bending apparatus 0 performs the following operations on a steel pipe 1 which is a blank (a material to be processed) and which is supported by a support means 2 so as to be movable in its axial direction while feeding the steel pipe 1 from an upstream side towards a downstream side using a feed device 3 such as a ball screw:

(a) rapidly heating a portion of the steel pipe 1 with a high frequency heating coil 5 located downstream of the support means 2 to a temperature range in which quench-hardening is possible, (b) rapidly cooling the steel pipe 1 with a water cooling device 6 disposed downstream of the high frequency heating coil 5, and (c) imparting a bending moment to the heated portion of the steel pipe 1 to perform bending by two-dimensionally or three-dimensionally varying the position of a movable roller die 4 having at least one set of roll pairs 4*a* which can support the steel pipe 1 while feeding it.

List of Prior Documents

Patent Document 1: WO 2006/093006

Non-Patent Document 1: Jidosha Gijustsu (Journal of Society of Automotive Engineers of Japan), Vol. 57, No. 6, 2003, pp. 23-28

DISCLOSURE OF INVENTION

As a result of diligent investigations aimed at further improving the bending apparatus 0, the present inventors found that the bending apparatus 0 has the following problems.

(a) A feed device 3 using a ball screw or the like needs to be set up in accordance with the type of steel pipe 1. The set-up requires a considerable time. As a result, the cycle time of the bending apparatus 0 is increased and its productivity is degraded. In addition, when the path line of the steel pipe 1 is changed, it is necessary to adjust the installation position of the feed device 3 in accordance with the change in the path line, leading to a decrease in the productivity of the bending apparatus 0.

(b) A feed device 3 using a ball screw or the like feeds a steel pipe 1 by driving the ball screw after the steel pipe 1 has been set in the feed device. Therefore, it is difficult to shorten the production tact time.

(c) It is necessary to synchronize the operational timing of a feed device 3 using a ball screw or the like and a movable roller die 4. However, it is difficult to accurately synchronize them, and if they are not accurately synchronized, the dimensional accuracy of a bent member becomes worse.

(d) A large installation space is required for a feed device 3 using a ball screw or the like and a support device for supporting a roller die 4 so that the die 4 can move three-dimensionally. This creates limitations on where the bending apparatus 0 can be installed.

(e) In the case of a steel pipe 1 being a welded steel pipe, a feed device 3 using a ball screw or the like cannot perform operations other than feeding when the steel pipe 1 is set therein (such as rotating a steel pipe 1 about its axis so that the position of the weld bead on the steel pipe 1 is adjusted to a position which does not cause problems during bending, adjusting any offset of the longitudinal axis of the steel pipe 1 when it is set therein, and adjusting the feed path, leading to a decrease in the productivity of the bending apparatus 0.

(f) A feed device 3 using a ball screw or the like and a movable roller die 4 having at least one set of roll pairs 4*a* require extremely precise operation, which makes it necessary to periodically carry out cleaning and repair of these components. However, the maintainability of the feed device 3 and the movable roller die 4 is not good. Therefore, repair and cleaning of the feed device 3 and the movable roller die 4 require a considerable amount of time and man-hours.

As a result of diligent investigations for solving the above-described problems, the present inventors found that the above-described problems (a)-(f) can be solved by using an industrial robot of the vertically articulated type, for example, as at least a feed device and , if necessary, using an industrial robot of the vertically articulated type, for example, as a support device for a movable roller die or as a device for preventing a reduction in dimensional accuracy installed on the exit side of the movable roller die in order to increase dimensional accuracy. As a result of further investigations, they completed the present invention.

The present invention is a bending apparatus comprising a feed mechanism, a first support mechanism, a heating mechanism, a cooling mechanism, a second support mechanism, and a deformation preventing mechanism each satisfying the following conditions:

the feed mechanism being constituted by a first industrial robot and capable of feeding a hollow metal blank having a closed cross section in its lengthwise direction, the first support mechanism being fixed at a first position and capable of supporting the metal blank while feeding it, the heating mechanism being fixed at a second position which is located downstream of the first position in the direction for feeding the metal blank, and capable of heating a part or all of the fed metal blank, the cooling mechanism being fixed at a third position which is located downstream of the second position in the direction for feeding the metal blank, and capable of cooling the portion of the fed metal blank which has been heated by the heating mechanism, the second support mechanism being disposed at a fourth position which is located downstream of the third position in the direction for feeding the metal blank, and capable of imparting a bending moment to the heated portion of the metal blank by moving two-dimensionally or three-dimensionally while supporting the fed metal blank in at least one location, thereby processing the metal blank so as to be bent into required shape, and the deformation preventing mechanism being disposed at a fifth position which is located downstream of the fourth position in the direction for feeding the metal blank, and capable of preventing deformation of the fed metal blank.

According to the present invention, the above-described problems (a)-(f) of bending apparatus 0 can be solved. Thus, the present invention can provide a bending apparatus which has much higher productivity, occupies less space, and is easier to maintain than bending apparatus 0, and can manufacture long metal bent members having a closed cross section with high dimensional accuracy.

LIST OF REFERENTIAL NUMERALS

Figure 1:
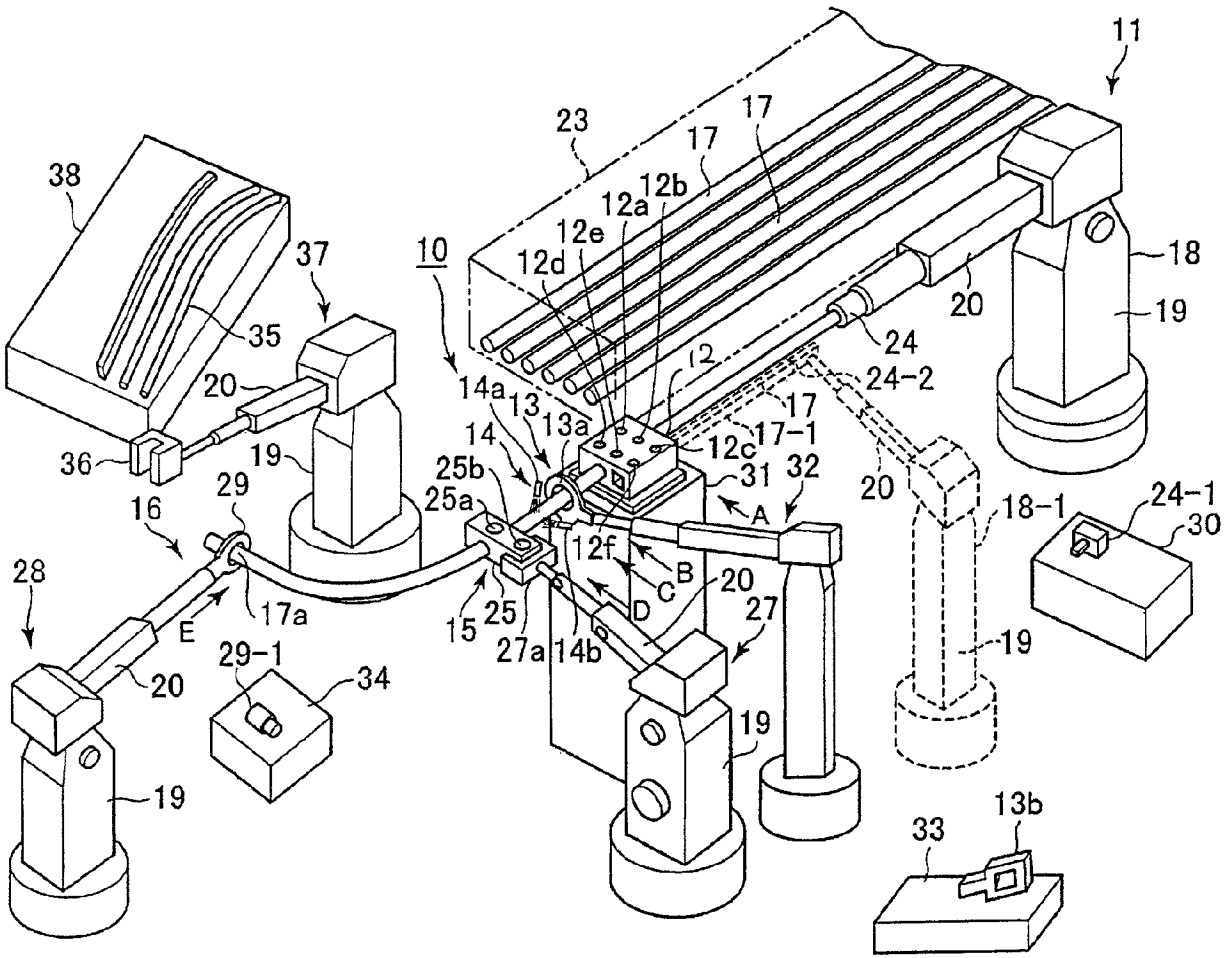
FIG. 1 is a perspective view showing the structure of a bending apparatus according to the present invention.

0: bending apparatus disclosed in Patent Document 1
1: steel pipe
2: support means
3: feed device
4: movable roller die
4*a*: roll pair
5: high-frequency heating coil
6: cooling device
10: bending apparatus according to the present invention
11: feed mechanism
12: first support mechanism
12*a*-12*f*: rolls
13: heating mechanism
13*a*, 13*b*: heating coils
14: cooling mechanism
14*a*, 14*b*: coolant spraying nozzles
15: second support mechanism
16: deformation preventing mechanism
17: steel pipe
17-1: other blank to be processed
17*a*: front end portion
18, 18-1: first industrial robots
19: upper arm
20: forearm
20*a*: wrist
21: controller
22: input unit
23: pallet
24, 24-1: end effector
25: movable roller die
25*a*, 25*b*: roll pairs
27: second industrial robot
27*a*: gripper
28: third industrial robot
29: gripper
29-1: replacement gripper
30: stand for replacement tool
31: support base
32: heating coil-supporting robot
33: stand for replacement heating coil
34: stand for replacement tool
35: bent product
36: gripper
37: handling robot
38: stand for products

EMBODIMENT OF THE INVENTION

Below, an embodiment of a bending apparatus according to the present invention will be explained. In the following explanation, an example will be given of the case in which a "hollow metal blank having a closed cross section" in the present invention is a steel pipe 17. The present invention is not limited to bending of a steel pipe, and it can be applied in the same manner to any hollow metal blank having a closed cross section.

FIG. 1 is a perspective view schematically showing the structure of a bending apparatus 10 according to the present invention in partially simplified and abbreviated form. In FIG. 1, a total of 6 industrial robots including a first industrial robot 18 through a third industrial robot 28 are shown with their manipulators and the like illustrated in schematic and simplified form.

The bending apparatus 10 comprises a feed mechanism 11, a first support mechanism 12, a heating mechanism 13, a cooling mechanism 14, a second support mechanism 15, and a deformation preventing mechanism 16. These components will be explained in this order.

[Feed Mechanism 11]

The feed mechanism 11 feeds a steel pipe 17 in its lengthwise direction. The feed mechanism 11 is constituted by a first industrial robot 18.

In the following explanation, an example will be given of the case in which the same type of robot as used in a second industrial robot 27 is used as a first industrial robot 18 and a third industrial robot 28.

Figure 2:
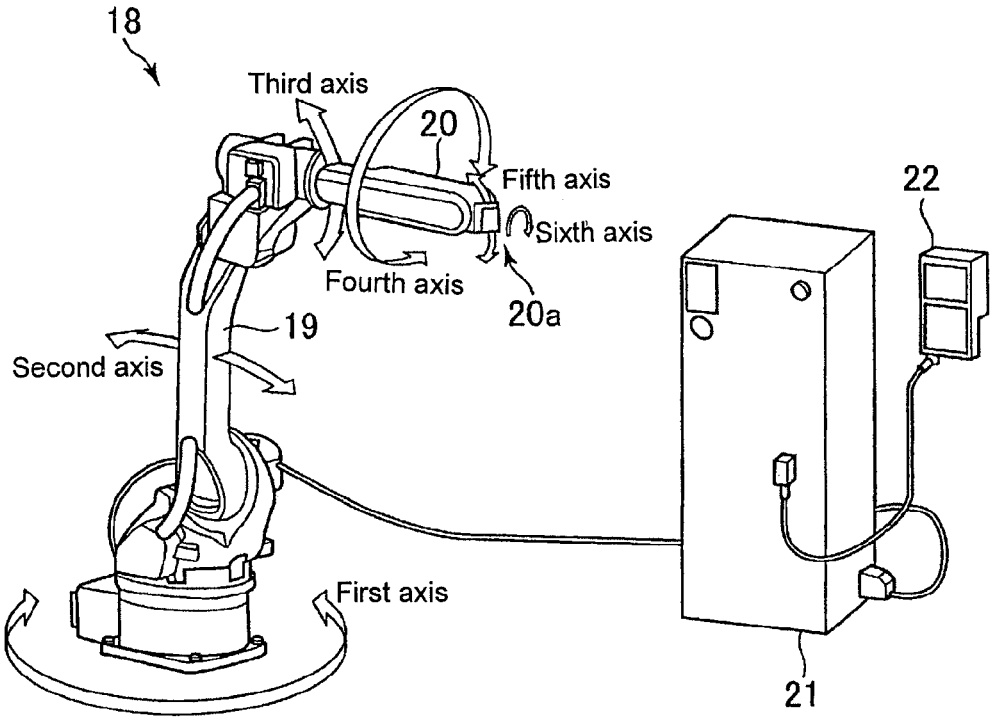
FIG. 2 is an explanatory view showing an example of the structure of a first through third industrial robots.
Figure 3:
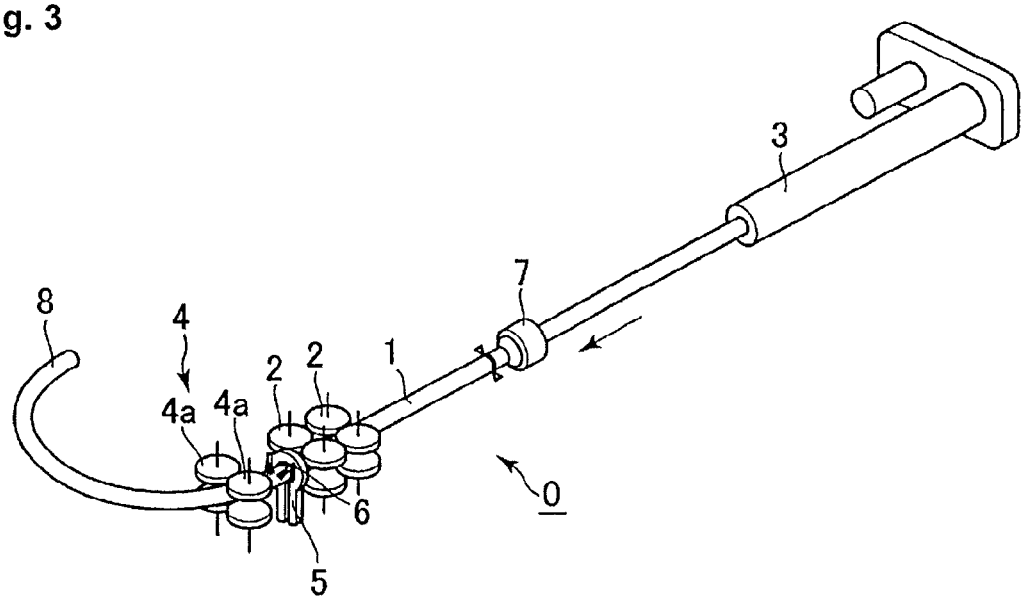
FIG. 3 is an explanatory view schematically showing the structure of a bending apparatus disclosed in Patent Document 1.

FIG. 2 schematically shows an example of the structure of the first industrial robot 18, the second industrial robot 27, and the third industrial robot 28 (referred to below as "industrial robots 18, 27, and 28").

The industrial robots 18, 27, and 28 are each so-called vertically articulated robots. The industrial robots 18, 27, and 28 each have a first through sixth axes.

The first axis allows an upper arm 19 to swing in a horizontal plane. The second axis allows the upper arm 19 to swing forwards and backwards. The third axis allows a forearm 20 to swing up and down. A fourth axis allows the forearm 20 to rotate. The fifth axis allows a wrist 20*a* to swing up and down. The sixth axis allows the wrist 20*a* to rotate.

If necessary, in addition to the first through sixth axes, the industrial robots 18, 27, and 28 may have a seventh axis which allows the upper arm 19 to pivot. The movement of the first through seventh axes is driven by AC servomotors.

The industrial robots 18, 27, and 28 need not have six or seven axes and may have five axes. The number of axes of these industrial robots may be selected such that the movement necessary for processing can be carried out.

Like other general-purpose industrial robots, industrial robots 18, 27, and 28 each have a controller 21 which performs overall control of the movement of the axes and an input unit 22 for inputting instructions concerning movement.

An end effector 24 is provided at the front end of the wrist 20*a* of the first industrial robot 18. The end effector 24 is used for gripping a steel pipe 17 housed in a pallet disposed in the vicinity and to the side of first industrial robot 18 and for passing the gripped steel pipe 17 through holes provided in the first support mechanism 12 and the heating mechanism 13.

The end effector 24 may be of a type which grasps the outside of a steel pipe 17 in the tail portion, or it may be of a type which is inserted into the inside of a steel pipe 17 in the tail portion. The end effector 24 shown in FIG. 1 is of the type having a protuberance which is inserted inside the tail portion of a steel pipe 17.

The end effector 24 which is used can be suitably modified in accordance with the shape and dimensions of the tail portion of the metal blank which undergoes bending. The bending apparatus 10 has a stand 30 for replacement tool provided in the vicinity of first industrial robot 18. A replacement end effector 24-1 with the automatic function for exchanging tools is provided on the replacement tool stand 30. When the blank to be processed is changed to another blank to be processed 17-1 other than a steel pipe 17 (in the illustrated example, a rectangular pipe having a rectangular cross section), the first industrial robot 18 moves pivotally and replaces the end effector 24 by the replacement end effector 24-1. In this manner, replacement of the end effector 24 is carried out extremely rapidly.

As shown by dashed lines in FIG. 1, another first industrial robot 18-1 may be installed together with first industrial robot 18. During the feed operation of steel pipe 17 by the first industrial robot 18, the other first industrial robot 18-1 picks up another blank to be processed 17-1 from the pallet 23 and passes the other blank 17-1 through a hole formed in the below-described first support mechanism 12. The first industrial robot 18-1 positions a suitable end effector at the tail portion of the other blank 17-1 and waits. When the feed operation of the steel pipe 17 by the first industrial robot 18 is completed, the installation position of the heating coil 13*a* controlled by the below-described heating coil-supporting robot 32 and the installation position of a movable roller die 25 controlled by the second support mechanism 15 are both changed in accordance with the path line of the other blank 17-1. As a result, the other first industrial robot 18-1 can immediately begin feeding of the other blank 17-1, and the production tact time of the bending apparatus 10 is shortened.

In the same manner as the above-described first industrial robot 18, the other first industrial robot 18-1 is a so-called vertically articulated robot having a first through sixth axes and if necessary a seventh axis. The movement of the first through seventh axes is driven by AC servomotors.

Since the first industrial robot 18 performs moving of a steel pipe 17 from the pallet 23 and setting thereof, the cycle time of the bending apparatus 10 is shortened leading to an increase in the productivity of the bending apparatus 10.

[First Support Mechanism 12]

The first support mechanism 12 is mounted on a support base 31. The first support mechanism 12 is fixed at a first position A. The first support mechanism 12 supports the steel pipe 17 while feeding it. As in the bending apparatus 0, the first support mechanism 12 comprises a die. The die has a plurality of rolls 12*a*-12*f* which can support a blank being fed by the feed mechanism 11 while feeding the blank.

The steel pipe 17 is fed by rolls 12*a* and 12*b* and rolls 12*d* and 12*e*. The other blank 17-1 is fed by rolls 12*b* and 12*c* and rolls 12*e* and 12*f*. Namely, the path line of the steel pipe 17 is formed by rolls 12*a* and 12*b* and rolls 12*d* and 12*e*, while the path line of the other blank 17-1 is formed by rolls 12*b* and 12*c* and rolls 12*e* and 12*f*.

The number and shape of the plurality of rolls 12*a*-12*f* and their placement inside a die can be suitably decided in accordance with the shape, the dimensions, and the like of the blanks to be processed 17, 17-1 which are to be fed.

This type of die is well known to and conventionally used by one skilled in the art, so a further explanation of the first support mechanism 12 will be omitted.

[Heating Mechanism 13]

The heating mechanism 13 is installed at a second position B, which is located downstream of the first position A in the direction of feeding the steel pipe 17. The heating mechanism 13 is supported and positioned by a heating coil-supporting robot 32. The heating mechanism 13 can heat a portion or all of the steel pipe 17 being fed.

The heating mechanism 13 is constituted by an induction heating device. The induction heating device has a heating coil 13*a* disposed around the steel pipe 17 with some space therefrom. This heating coil 13*a* is well known to and conventionally used by those skilled in the art.

Like the above-described first industrial robot 18, the heating coil-supporting robot 32 is a vertically articulated robot which has a first through sixth axes and if necessary a seventh axis. The movement of the first through seventh axes is driven by AC servomotors.

When heating the other blank to be processed 17-1, a replacement heating coil stand 33 is installed in the vicinity of the heating coil-supporting robot 32. A replacement heating coil 13*b* which has an automatic tool change function is disposed on the stand 33. When a steel pipe 17 is replaced by a different blank 17-1, the heating coil-supporting robot 32 moves pivotally and replaces the heating coil 13*a* by the heating coil 13*b*. In this manner, the heating coil 13*b* is exchanged extremely rapidly.

A further explanation of the heating mechanism 13 will be omitted.

[Cooling Mechanism 14]

The cooling mechanism 14 is fixed at a third position C, which is located downstream of the second position B in the direction of feeding the steel pipe 17. The cooling mechanism 14 cools the portion of the steel pipe 17 being fed which was heated by the heating mechanism 13. As a result, the cooling mechanism 14 defines a high temperature region in a portion of the lengthwise direction of the steel pipe 17. The high temperature region has a greatly decreased resistance to deformation.

The cooling mechanism 14 has, for example, coolant spraying nozzles 14*a*, 14*b* spaced from the outer surface of the steel pipe 17. An example of a coolant is cooling water. These coolant spraying nozzles 14*a*, 14*b* are well known to and conventionally used by those skilled in the art, so a further explanation of the cooling mechanism 14 will be omitted.

[Second Support Mechanism 15]

The second support mechanism 15 is disposed at a fourth position D, which is located downstream of the third position C in the direction of feeding the steel pipe 17. The second support mechanism 15 can move two-dimensionally or three-dimensionally while supporting the steel pipe 17 being fed in at least one location. As a result, the second support mechanism 15 imparts a bending moment to the high temperature region of the steel pipe 17 (the region between locations B and C) and causes the steel pipe 17 to be bent to a desired shape.

As in the bending apparatus 0, the second support mechanism 15 comprises a movable roller die 25. The movable roller die 25 has at least one set of roll pairs 25*a*, 25*b* which can support the steel pipe 17 while feeding it.

The movable roller die 25 is supported by a second industrial robot 27. The second industrial robot 27 is a playback robot of the CP (continuous path) controlled type. A playback robot of the CP type can continuously store a path which is finely divided between adjoining teaching points and the time of passage along the finely divided path.

Like the above-described first industrial robot 18, the second industrial robot 27 is a so-called vertically articulated robot having a first through sixth axes and if necessary a seventh axis. The movement of the first through seventh axes is driven by AC servomotors.

A gripper 27*a* is provided at the tip of the wrist 20*a* of the second industrial robot 27 as an end effector for holding the movable roller die 25. The end effector may be of a type other than a gripper 27*a*.

The movable roller die 25 may be supported by a plurality of industrial robots including the second industrial robot 27 so that the load on each industrial robot can be decreased and the accuracy of the path of the movable roller die 25 can be increased.

[Deformation Preventing Mechanism 16]

The deformation preventing mechanism 16 is disposed at a fifth position E, which is located downstream of the fourth position D in the direction of feeding a steel pipe 17. The deformation preventing mechanism 16 prevents the steel pipe 17 being fed from deforming due to its weight and a stress which develops during cooling.

A third industrial robot 28 is used to constitute the deformation preventing mechanism 16.

Like the above-described first industrial robot 18 and the second industrial robot 27, the third industrial robot 28 is a so-called vertically articulated robot having a first through sixth axes and if necessary a seventh axis. The movement of the first through seventh axes is driven by AC servomotors.

A gripper 29 which grips the outer surface of the steel pipe 17 is provided on the tip of the wrist 20*a* of the third industrial robot 28 as an end effector for holding the front end portion 17*a* of the steel pipe 17.

The end effector can, of course, be an end effector of a type other than a gripper 29 (such as one which is inserted into the bore of the steel pipe 17). For example, a stand 34 for replacement tool may be disposed in the vicinity of the third industrial robot 28. A replacement gripper 29-1 of the type which is inserted inside the steel pipe 17 is disposed on the tool stand 34. When the steel pipe 17 being processed is replaced by a blank 17-1 other than a steel pipe, the third industrial robot 28 moves pivotally to replace the gripper 29 by the gripper 29-1. As a result, the gripper 29-1 is replaced extremely rapidly.

A handling robot 37 is installed downstream of the third industrial robot 28. The handling robot 37 has a gripping portion 36 at the tip of its wrist 20*a*. The gripping portion 36 holds a bent product 35 after the completion of bending. The handling robot 37 is a playback robot of the CP type.

Like the above-described first industrial robot 18, the handling robot 37 is a vertically articulated robot having a first through sixth axes and if necessary a seventh axis. The movement of the first through seventh axes is driven by AC servomotors.

The handling robot 37 holds a bent product 35 which has been bent. The handling robot 37 moves the bent product 35 which it holds to a stand 38 for products.

The bending apparatus 10 preferably carries out bending in a warm or hot state. A warm state is a temperature range in which the resistance to deformation of a metal material is decreased compared to room temperature. For example, with certain metal materials, it is a temperature range of around 500-800° C. A hot state is a temperature range in which the resistance to deformation of a metal material is decreased compared to room temperature and in which quench hardening of the metal material is possible. For example, with some steel materials, it is a temperature range of 870° C. or higher.

When carrying out bending of a steel pipe 17 in a hot state, the steel pipe 17 undergoes quench hardening by being heated to a temperature range in which quench hardening is possible followed by cooling at a prescribed cooling rate. When bending of a steel pipe 17 is carried out in a warm state, the occurrence of strains of the steel pipe accompanying working such as thermal strains is prevented.

The bending apparatus 10 has a structure as described above.

Due to the feed mechanism 11 having a first industrial robot 18, the following effects are achieved when the bending apparatus 10 performs two-dimensional or three-dimensional bending of a steel pipe 17.

(a) Set-up of the apparatus which is inevitably carried out when the type of the steel pipe 17 is changed can be easily and rapidly performed. Therefore, the cycle time of the bending apparatus 10 is prevented from increasing, and the productivity of the bending apparatus 10 is improved. In addition, set-up of the apparatus which is unavoidably carried out when the pass line of the steel pipe 17 changes is easily and rapidly performed. Therefore, the degree of freedom of production by the bending apparatus 10 and its productivity are both increased. Furthermore, a pallet 23 which houses steel pipes 17 can be disposed inside the operating range of the first industrial robot 18.

(b) The first industrial robot 18 which constitutes the feed mechanism 11 is also used as a handling robot. Therefore, after the first industrial robot 18 sets a blank 17 in position, it can immediately feed the blank 17 in its longitudinal direction, and the cycle time of the bending apparatus 10 is shortened.

(c) The operational timing of first industrial robot 18 and the operational timing of other devices such as the second industrial robot 27, the heating coil-supporting robot 32, and the third industrial robot 28 can be easily synchronized. Therefore, the dimensional accuracy of a bent product 35 can be improved by freely varying the feed speed of the steel pipe 17 (such as by lowering the feed speed of a bent portion of a bent member). In addition, when the first industrial robot 18 is worked at first, it is easier to operate other devices such as the second industrial robot 27, the heating coil-supporting robot 32, and the third industrial robot 28 at the same time.

(d) Since the first industrial robot 18 is used as a feed mechanism 11, the overall installation space of the bending apparatus 10 can be reduced by disposing the first industrial robot 18 as close as possible to the first support mechanism 12, for example. As a result, limitations on where the bending apparatus 10 can be installed are reduced.

(e) Because the first industrial robot 18 is used as a component of a feed mechanism 11, it is possible to carry out operations other than feeding, such as (1) when the steel pipe 17 is a welded steel pipe, rotating the steel pipe 17 around its longitudinal axis so that the weld bead of the steel pipe 17 is in a position which does not interfere with bending before setting the steel pipe 17 in the bending apparatus 10, (2) adjusting any offset of the axis of the steel pipe 17 when it is set, (3) adjusting the feed path of the steel pipe 17, (4) repeatedly imparting minute vibrations to the steel pipe 17 in order to reduce the coefficient of friction with the first support mechanism 12 or the second support mechanism 15, and (5) adjusting the offset of the axis of the steel pipe 17 so as to obviate the occurrence of the stick-slip phenomenon. As a result, the degree of freedom of production of the bend apparatus 10 is increased.

When the first industrial robot 18 also carries out an operation of varying the position of the weld bead of a welded steel pipe, a well known conventional weld bead position sensor is provided on the first industrial robot 18. The angle of rotation of the steel pipe 17 can be set by calculations based on the value sensed by the weld bead position sensor.

(f) The first industrial robot 18 can be constituted by a general-purpose industrial robot having a proven production record. Therefore, it can be easily maintained, and the time and man hours required for maintenance and cleaning are reduced.

(g) The first industrial robot 18 can carry out a minute correction of the feed path of the steel pipe 17 in accordance with the orientation of the first support mechanism 12, whereby the dimensional accuracy of a bent product 35 is increased.

The invention claimed is:

1. A hot-state or warm state bending apparatus characterized by comprising a feed mechanism for a metal blank, which is constituted by a first industrial robot, a first support mechanism fixed at a first position downstream of the feed mechanism in a feeding direction for the metal blank, a heating mechanism disposed at a second position which is located downstream of the first position in the feeding direction, a cooling mechanism fixed at a third position which is located downstream of the second position in the feeding direction, a second support mechanism disposed at a fourth position which is located downstream of the third position in the feeding direction, and a deformation preventing mechanism disposed at a fifth position which is located downstream of the fourth position in the feeding direction:

the metal blank being hollow and having a closed cross section and in its lengthwise the metal blank being fed, the feed mechanism feeding the metal blank in the feeding direction, the first support mechanism supporting the metal blank while feeding it in the feeding direction, the heating mechanism heating a part or all of the fed metal blank while the metal blank is being fed through the heating mechanism, the cooling mechanism cooling the portion of the fed metal blank which has been heated by the heating mechanism while the metal blank is being fed through the cooling mechanism, the second support mechanism imparting a bending moment to the heated portion of the metal blank by moving two-dimensionally or three-dimensionally while supporting the fed metal blank in at least one location of the metal blank, thereby processing the metal blank so as to be bent into a required shape, and the deformation preventing mechanism preventing deformation of the fed and shaped metal blank by gripping the metal blank to support the shaped metal blank so that deformation caused not only by a weight of the shaped metal blank, but also by stress introduced when cooling the metal blank, can be prevented while the shaped metal blank being fed through the supporting mechanism.

2. A bending apparatus as set forth in claim 1 characterized in that the second support mechanism is supported by at least one second industrial robot.

3. A bending apparatus as set forth in claim 1 characterized in that the deformation preventing mechanism is constituted by a third industrial robot.

4. A bending apparatus as set forth in claim 1 wherein at least one of the first industrial robot, the second industrial robot, and the third industrial robot is a vertically articulated robot.

5. A bending apparatus as set forth in claim 4 wherein the vertically articulated robot has at least five axes.

* * * * *